United States Patent [19]

Sasaki

[11] 3,976,406

[45] Aug. 24, 1976

[54] OIL SEAL MEANS OF A ROTARY PISTON ENGINE

[75] Inventor: Yoshio Sasaki, Toyota, Japan

[73] Assignee: Toyota Jidosha Kogyo Kabushiki Kaisha, Toyota, Japan

[22] Filed: Sept. 18, 1974

[21] Appl. No.: 507,238

[30] Foreign Application Priority Data

May 20, 1974 Japan ..... 49-56350

[52] U.S. Cl. ..... 418/142

[51] Int. Cl.[2] ..... F01C 19/00; F04C 15/00; F04C 27/00

[58] Field of Search ..... 418/142; 277/136, 137

[56] References Cited

UNITED STATES PATENTS

| | | | |
|---|---|---|---|
| 3,575,541 | 4/1971 | Hamada | 418/142 |
| 3,820,925 | 6/1974 | Uchiyama et al. | 418/142 |
| 3,853,440 | 12/1974 | Green | 418/142 |

FOREIGN PATENTS OR APPLICATIONS

| | | | |
|---|---|---|---|
| 626,302 | 9/1927 | France | 277/137 |
| 244,590 | 2/1926 | Italy | 277/136 |
| 441,224 | 1/1936 | United Kingdom | 277/137 |

OTHER PUBLICATIONS

1 B424,572, Jan. 1975, Rose, 418/142.

*Primary Examiner*—C. J. Husar
*Assistant Examiner*—Leonard Smith
*Attorney, Agent, or Firm*—Stewart and Kolasch, Ltd.

[57] ABSTRACT

An oil seal means of a rotary piston engine wherein an oil seal ring is mounted in an annular oil seal groove formed as a cut in a side wall portion of a rotor, wherein the oil seal ring has at least one projection radially projecting from its front circumferential edge portion, said projection being in engaging relationship with a corresponding notch formed at an annular opening edge portion of said annular oil seal groove for the purpose of preventing the ring from circumferentially sliding along the annular oil seal groove.

2 Claims, 5 Drawing Figures

OIL SEAL MEANS OF A ROTARY PISTON ENGINE

BACKGROUND OF THE INVENTION

1. Field of the Invention:

The present invention relates to an oil seal means of a rotary piston engine and, more particularly, to an oil seal means of a rotary piston engine wherein an oil seal ring which is mounted in an annular oil seal groove formed as a cut in a side wall portion of a rotor is provided with a resilient spring force which urges said ring outwardly from said oil seal groove thereby maintaining oil and gas tightness between the side wall of the rotor and a wall of a side or intermediate housing.

2. Description of the Prior Art:

A rotary piston engine has a general structure as exemplarly shown in FIG. 1, wherein a center housing 1 having a trochoidal inner surface is closed at its opposite ends by side or intermediate housings to define a chamber therein in which is mounted a polygonal rotor 4 which is adapted to make planetary movement around an eccentric shaft 3. While the rotor rotates in said chamber, the gas and oil tightness between a side wall of the rotor and an inner wall of the side housing 2 is maintained by an oil seal means generally designated by reference numeral 5. This oil seal means is conventionally composed of an annular oil seal groove formed as cut in the side wall of the rotor and an oil seal ring mounted in said groove, said oil seal ring being resiliently supported at its rear face by a corrugated spring or the like mounted between the rear face of the oil seal ring and a bottom wall of the annular oil seal groove so that the oil seal ring is urged outwardly from the annular oil seal groove and pushed against the wall surface of the side or intermediate housing at its front end portion in order to maintain oil and gas tightness at the contacting portion. Furthermore, a fluid passage which traverses an annular space left between the oil seal ring and wall portions of the annular oil seal groove is normally interrupted by an elastic O-ring.

In the conventional oil seal means of the aforementioned structure, if the oil and gas tightness at the contacting portion between the front end portion of the oil seal ring and the wall surface of the side or intermediate housing is to be maintained satisfactorily, the spring force for pressing the oil seal ring against the wall surface of the side or intermediate housing must be relatively strong. However, if this urging force is too strong it becomes difficult for the oil seal ring to follow the rotation of the rotor as it rotates, thereby causing the oil seal ring to slide circumferentially along the annular oil seal groove. If the circumferential sliding of the oil seal ring occurs in the annular oil seal groove, an elastic sealing member, such as an O-ring mounted between the annular oil seal groove and the oil seal ring, will suffer serious wear, resulting in detioration of its sealing performance within a short period of time. To overcome this problem, it has been proposed in the Laid Open Japanese Publication Sho 48-16204 to provide a notch at the rear face portion of the oil seal ring, said notch being engaged with an end portion of the corrugated spring which supports the rear face of the oil seal ring while the other end of said corrugated spring is engaged with a notch formed at a bottom wall portion of the annular oil seal groove. However, since the oil seal ring has to be resilient enough to follow, satisfactorily, a slightly concaved and convexed wall surface of the side or intermediate housing according to the rotation of the rotor, it is usually formed of a relatively thin member having a substantially U-shaped cross section which defines a concaved portion in which an O-ring is mounted. However, if an oil seal ring having a relatively thin cross section is provided with the aforementioned notch in a portion thereof, there is the problem that a crack might occur in said notch whereby breakage of the oil seal ring might result, especially during high speed operation of the rotor.

SUMMARY OF THE INVENTION

Therefore, it is the object of the present invention to solve the aforementioned problems and to provide an improved oil seal means having a structure which prevents the aforementioned circumferential sliding of the oil seal ring in the annular oil seal groove without sacrificing the strength and durability of the oil seal ring.

According to the present invention, the abovementioned object is accomplished by an oil seal means of a rotary piston engine comprising an oil seal ring which is mounted in an annular oil seal groove formed as a cut in a side wall portion of a rotor and provided with a resilient spring force which urges said ring outwardly from said oil seal groove, characterized in that said oil seal ring has at least one projection which projects from its front circumferential edge portion in a radial direction of the rotor, said projection being adapted to engage with a corresponding notch formed at an annular opening edge portion of said annular oil seal groove.

In the oil seal means of the aforementioned structure, the oil seal ring is provided with a projection (or projections) instead of a notch which extends in the radial direction of the rotor and, therefore, the strength of the oil seal ring is not adversely affected. In this case, the wall of the side or intermediate housing has only to be provided with a notch at a peripheral portion of the opening of the annular oil seal groove and, therefore, there is no danger that a notch of this kind can substantially affect the strength of the side or intermediate housing. Furthermore, such a notch can be formed very easily.

The oil seal means according to the present invention may favorably be applied in a situation where the cooperating annular oil seal groove and oil seal ring are provided in duplicate to be arranged close to, and substantially coaxially with, each other around the center of the rotor. In this case, a first oil seal ring located radially outside may preferably be provided with said projection at its front inside circumferential edge portion, while a second oil seal ring located radially inside may preferably be provided with said projection at its front outside circumferential edge portion, said notch being conveniently formed at an annular land portion disposed between said two annular oil seal grooves.

According to another particular feature of the present invention, said oil seal ring may have a U-shaped cross section formed of relatively thin first, second and third cross sectional portions extending respectively in radial, axial and radial directions of the rotor, said ring being adapted to contact a wall of the side or intermediate housing by a portion of said first cross sectional portion, wherein said projection is formed at a portion of said first cross sectional portion. An O-ring may be provided in the concaved portion of said U-shaped cross section. In this case, when said first cross sectional portion is connected at its radial outer end portion with said second cross sectional portion, said projection may preferably be provided at a radially inner end portion of said first cross sectional portion. On the other hand, when said first cross sectional portion is connected at its radially inner end portion with said second cross sectional portion, said projection may preferably be provided at a radially outer end portion of said first cross sectional portion. The structure wherein said projection is provided at a radially inner end portion of said first cross sectional portion is suitable for said first oil seal ring in the aforementioned double oil seal ring structure, while the structure wherein said projection is provided at the radially outer end portion of said first cross sectional portion is suitable for said second oil seal ring in said double structure.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

In the following, the present invention will be described in more detail with respect to a preferred embodiment and with reference to the accompanying drawing, particularly FIGS. 2-5 thereof.

Figure 1:
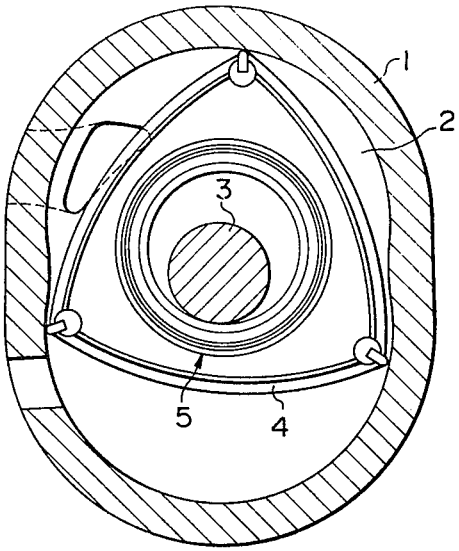
FIG. 1 is a sectional view showing a general construction of the rotary piston engine, but the rotor is shown in its side view to illustrate its side structure.
Figure 2:
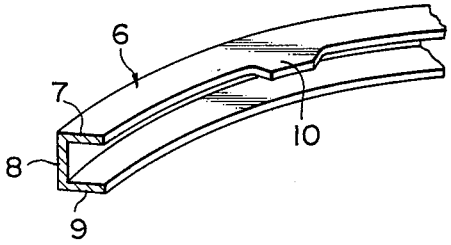
FIG. 2 is a perspective view showing a part of an embodiment of the oil seal ring to be incorporated in the oil seal means according to the present invention.

Referring to FIG. 2, the oil seal ring 6 has a U-shaped cross section formed of relatively thin first, second and third cross sectional portions 7, 8 and 9 which, in the operating condition of the ring, extend respectively in radial, axial and radial directions of the rotor. The first cross sectional portion 7 is formed with a projection 10 at a portion of its radially inner edge.

Figure 3:
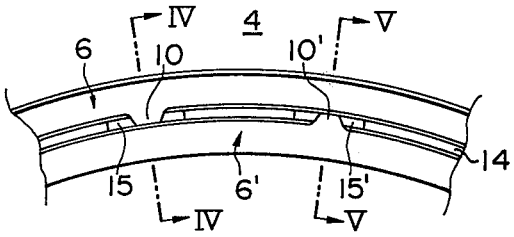
FIG. 3 is a view of an essential part of an embodiment of the present invention as seen from the rotor side, wherein the oil seal means incorporates double oil seal rings.
Figure 4:
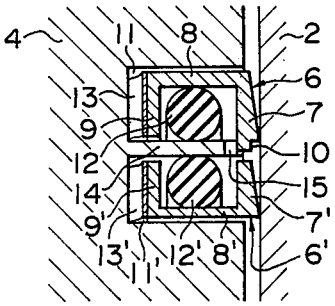
FIG. 4 is a sectional view along line IV—IV in FIG. 3.
Figure 5:
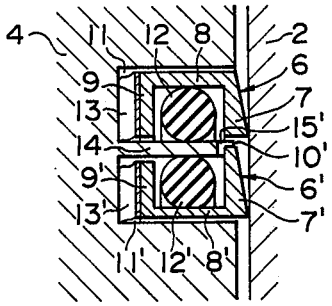
FIG. 5 is a sectional view along line V—V in FIG. 3.

FiG. 3 shows an oil seal means constructed as a double structure incorporating the oil seal ring 6 as shown in FIG. 2 and another oil seal ring 6'. The cross sectional structures at the portions of lines IV—IV and V—V are shown in FIGS. 4 and 5, respectively. In the embodiment shown in FIGS. 3–5, the side wall of the rotor 3 is formed with two annular oil seal grooves 11 and 11' which are arranged closely to, and substantially coaxially with, each other around the center of the rotor. The oil seal rings 6 and 6' are received in the oil seal grooves 11 and 11', respectively.

As shown in FIGS. 4 and 5, the oil seal ring 6' has a structure similar to the oil seal ring 6 and is formed to have a U-shaped cross section formed of relatively thin first, second and third cross sectional portions 7', 8' and 9' which extend in radial, axial and radial directions of the rotor, respectively. However, it will be noted that the oil seal rings 6 and 6' are contrary to each other with respect to the position of their concaved portions defined by the U-shaped cross section in relation to the curvature of the ring. A first O-ring 12 is mounted in the concaved portion of the U-shaped cross sectional oil seal ring 6, and a second O-ring 12' is mounted in the corresponding concaved portion of the oil seal ring 6'. These O-rings contact with portions of the annular oil seal grooves and the oil seal rings to intercept flow passages traversing the annular spaces left between the wall surfaces of the annular oil seal grooves and the oil seal rings. A first annular corrugated spring 13 is mounted between the rear face of the oil seal ring 6 and the bottom wall of the annular oil seal groove 11. Similarly, a second annular corrugated spring 13' is mounted between the rear face of the oil seal ring 6' and the bottom wall of the annular oil seal groove 11'. These annular corrugated springs apply spring forces to the oil seal rings 6 and 6' respectively, to urge them outwardly from the annular oil seal grooves 11 and 11' so that the oil seal rings are pushed against the wall surface of the side housing 2 at the front edge portions thereof.

The oil seal ring 6' is formed with a projection 10' which projects radially outwardly from a portion of the outer peripheral edge of said first cross sectional portion 7' thereof. The projections 10 and 10' provided at the oil seal rings 6 and 6' are engaged into notches 15 and 15' formed at an annular land portion 14 left between the annular oil seal grooves 11 and 11', respectively. Because the projections 10 and 10' of the oil seal rings 6 and 6' are engaged with the notches 15 and 15' of the annular land portion 14, the oil seal rings 6 and 6' are positively held from sliding circumferentially along the annular oil seal grooves 11 and 11'.

It will be apparent that the projection 10 or 10' as shown in the drawing can be very easily provided on the oil seal ring 6 or 6' and that the strength and durability of the oil seal ring will not be affected at all by utilizing projections of this kind. It will also be apparent that the notch 15 or 15' can also be very easily formed at an open circumferential edge portion of the annular oil seal groove 11 or 11', especially at the annular land portion 14 left between the two co-axial annular oil seal grooves in the case of the double structure as shown in FIGS. 3–5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An oil seal means of a rotary piston engine comprising two annular oil seal grooves provided in a sidewall portion of a rotor and arranged in close proximity with respect to each other and substantially coaxial with respect to each other around the center of the rotor, said oil seal grooves defining a relatively thin annular land portion disposed therebetween, two oil seal rings, one being mounted in each of said annular oil seal grooves, spring means provided in said annular oil seal grooves for applying a resilient force to said rings to urge the same outwardly from said grooves, said rings each having a substantially U-shaped cross section formed of a relatively thin first, second and third cross-sectional portion extending in the radial, axial and radial directions of the rotor, respectively, said first and third cross-sectional portions being connected to and supported by opposite ends of said second cross-sectional portion, said first sectional portion representing a free edge portion which sealingly contacts a wall of a side or intermediate housing, at least one projecting element which is a unitary extension of said free edge portion of said first sectional portion, at least two notches formed at said annular land portion in a manner to traverse the radial thickness of the annular land portion, said projecting element being in engaging relationship with said notches and O-rings provided in the concave portions of said U-shaped cross-sectional oil seal rings.

2. The oil seal means of claim 1, wherein the substantially U-shaped concaved portions of the oil seal ring face each other with said annular land portion being disposed therebetween.

* * * * *